US005657789A

United States Patent [19]

Tisbo et al.

[11] Patent Number: 5,657,789

[45] Date of Patent: Aug. 19, 1997

[54] WALL MOUNT STACKABLE HOSE REEL

[75] Inventors: Thomas A. Tisbo, Barrington Hills; Brian Moon, Sycamore, both of Ill.

[73] Assignee: Suncast Corporation, Batavia, Ill.

[21] Appl. No.: 514,439

[22] Filed: Aug. 11, 1995

[51] Int. Cl.[6] ..... B65H 75/34

[52] U.S. Cl. ..... 137/355.27; 137/580

[58] Field of Search ..... 137/355.27, 580

[56] References Cited

U.S. PATENT DOCUMENTS

| | | | |
|---|---|---|---|
| Re. 32,510 | 9/1987 | Tisbo et al. | 137/355.27 |
| 4,768,546 | 9/1988 | Brusadin et al. | 137/355.27 |
| 5,245,391 | 9/1993 | Tisbo et al. | 137/355.27 |

*Primary Examiner*—A. Michael Chambers
*Attorney, Agent, or Firm*—McHale & Slavin, P.A.

[57] ABSTRACT

The wall mount hose cart of the instant invention is of a shape and design allowing preassembly thereby eliminating the need for instruction manuals and associated product packaging necessary of wall mount hose reels that are sold in an unassembled state. The wall mount hose reel employs a single unitary frame for support of a flexible garden hose to be wound into a coil of multiple layers by use of a directional stress relieving hose reel spool. Reel flanges are oblong shaped for holding of the hose within the form spool yet providing the nesting ability for assembled carte. A handle is foldable for storage with locks concealed within the base of the handle and a syringe type hub attachment is further disclosed for removal and maintenance of the water seals without tools. Hub attachments are interchangeable allowing the crank to be attached to either side of the apparatus allowing left or right hand operation.

22 Claims, 8 Drawing Sheets

WALL MOUNT STACKABLE HOSE REEL

FIELD OF THE INVENTION

This invention relates to storage of flexible garden hoses and, more particularly, to an improved wall mount hose reel that is pre-assembled and shipped in stacked array.

BACKGROUND INFORMATION

The use of hose reels for convenient handling and storage of a flexible garden hose has gained wide public acceptance. Such hose reels can be mounted on a cart or secured to the wall and are primarily constructed of molded plastic components having a centrally disposed rotatable spool for reeling inward or outward the flexible hose, a frame including a pair of frame sides for supporting of a spool, and provision for mounting of the frame to the wall of a building. Hose reel carts and wall mounted hose reels are commonly purchased by the general consumer in a disassembled state requiring hand tools for assembly. The assembly can be time consuming and for the novice most frustrating as well as leading to damaged goods if the assembly is improperly prepared. For this reason, a problem that has arisen with hose reels of the prior art is that, despite the directions for assembly, a majority of the consuming public is unable or have no desire to assemble such devices. Cottage industries have developed solely for the purpose of assembling products that have been purchased in a disassembled state. Many stores that inventory unassembled products have personnel on staff capable of assembling the product. If this is performed as a courtesy the expense becomes a burden on the store. If the consumer pays to have the product assembled, the cost of the device increases.

Improper assembly can damage such devices when an assembler fails to follow instructions or tries to force fit a component. The result is aggravation by the purchaser who may ask the store to take the product back and refund their money. A store which takes back the product endures a time consuming paperwork ordeal which includes a request of the manufacturer to take back the product wherein the manufacturer must also perform paperwork as well as attempt to salvage the damaged product. Done unexpectedly, most returned items are damaged as a result of improper assembly.

The reason many such products are shipped unassembled is due to the size of packaging required once an assembled product is placed in an operating form. For instance, a hose reel shipped in a disassembled state can easily fit in a box that allows the device to be shipped on a pallet together with numerous other similar shaped boxes. Under such circumstances it is not unusual to have twenty or more boxes of wall mountable hose reels placed on a pallet wherein a forklift can be used for movement of the pallet. A receiving store may leave a shipment of packages on the shipping pallet above the normal reach of the consuming public. The boxed product is brought down to replenish those items purchased causing the store to decide whether to assemble the product before display.

Unassembled hose reels are packaged in a shipping carton to protect the product during shipping and storage, and more importantly, prevent loss of individual components before assembly. A great deal of time and expense goes into packaging of the product so as to provide as compact packaging as possible. The shipping carton must include indicia to indicate to the public what is within the contents of the carton. This adds an expense to the carton especially if the use of color graphics is provided which is preferred by store owners so that potential purchasers do not break open the cartons in an effort to determine the contents. In addition, the unassembled hose carts require the inclusion of assembly instructions.

Disposal of shipping cartons is also wasteful. Once a hose cart is assembled, the shipping carton is unusable for nearly any other purpose. The carton becomes a waste product that will hopefully be recycled but realistically adds mass to a landfill. Concern must also be made that the cartons are sized to allow for stackability when placed upon a pallet.

Another problem with the prior art is the securement of a reel hub unnecessary for the introduction of water. The reel hub must allow rotation yet allow the device to be hooked up to a water supply wherein the hose can be reeled inward or outward without interfering with the flow of water. Seals within the hub allow rotation without leakage. A problem occurs when the seals require service, either in the form of lubrication or replacement. This is commonly a problem in the northern states should the device be allowed to freeze. When the seals require service, the hub must be removed to facilitate replacement. Without proper tools the unit will be damaged. In most instanaces the attachment is performed by the use of screws requiring proper threading or identical replacement should the screws be lost to prevent damaging of the unit. Disassembly and assembly is complicated and many consumers simply forego it, leading to the early destruction of the device.

Thus what is lacking in the art is a wall mount hose reel that can be pre-assembled at the factory, shipped without the necessity of a conventional shipping container, and of such design the hose reels can be nested together to reduce storage space.

Thus what is also lacking in the prior art is a wall mountable hose reel having an improved reel assembly that can be disassembled without tools and includes a means for reducing stress from a hose wrapped around the reel.

SUMMARY OF THE INVENTION

Among the several aspects and features of the present invention may be noted, the hose reel of the present invention is of the shape and design so that the hose reel may be preassembled at the factory thereby eliminating the need for instructional manuals and associated product packaging. The teaching of the instant invention allows for a plurality of preassembled wall mountable hose reels to be placed upon a skid decreasing the amount of space necessary for storage and transportation thereby increasing the number of units that may be shipped per a given cubic volume of space. In order to accomplish efficiency in shipping and the elimination of shipping cartons, the instant invention incorporates the use of an oblong shaped reel flange, and a one-piece inverted V-shaped frame so as to prevent nesting of multiple units. In addition, the frame includes interlocking fingers.

The preassembled hose reel of the instant invention permits the use of a single unitary frame construction for support of a flexible garden hose to be wound in a coil of multiple layers with adjacent turns of each layer touching each other by use of a directional reel forming a spool rotatably coupled to the frame. Reel flanges forming the side walls of the spool are oblong shaped for holding of the hose within the spindle of the reel in a similar manner as the prior art, yet allowing for the aforementioned nesting of assembled hose reels.

An objective of the instant invention is to provide a wall mountable hose reel having a one-piece frame with all components preassembled so as to eliminate the need for packaging and instruction manuals commonly used in the prior art.

Another objective of the instant invention is to provide a wall mountable hose reel that can be stacked on top of similar wall mountable hose reels in a nesting fashion teaching the ability to ship more units per cubic foot volume than possible with prior art and packaged individually even in a completely disassembled state.

Another objective of the instant invention is to disclose the use of quick release locking tabs that allow the crank of a winding spool to be placed on either side of the frame permitting left or right handed operation.

Yet still another objective of the instant invention is to provide a water connector that can be installed and removed without the use of hand tools. In particular, the connector will use a syringe type attachment mechanism that engages tabs on the inner surface of the hub to be disengaged for access to replaceable O-rings.

Still another objective of the instant invention is to teach the use of a handle locking mechanism for wall mountable hose reels that eliminate the need for a hock pin and can be incorporated into the frame of the wall mountable hose reel wherein it can be positioned.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
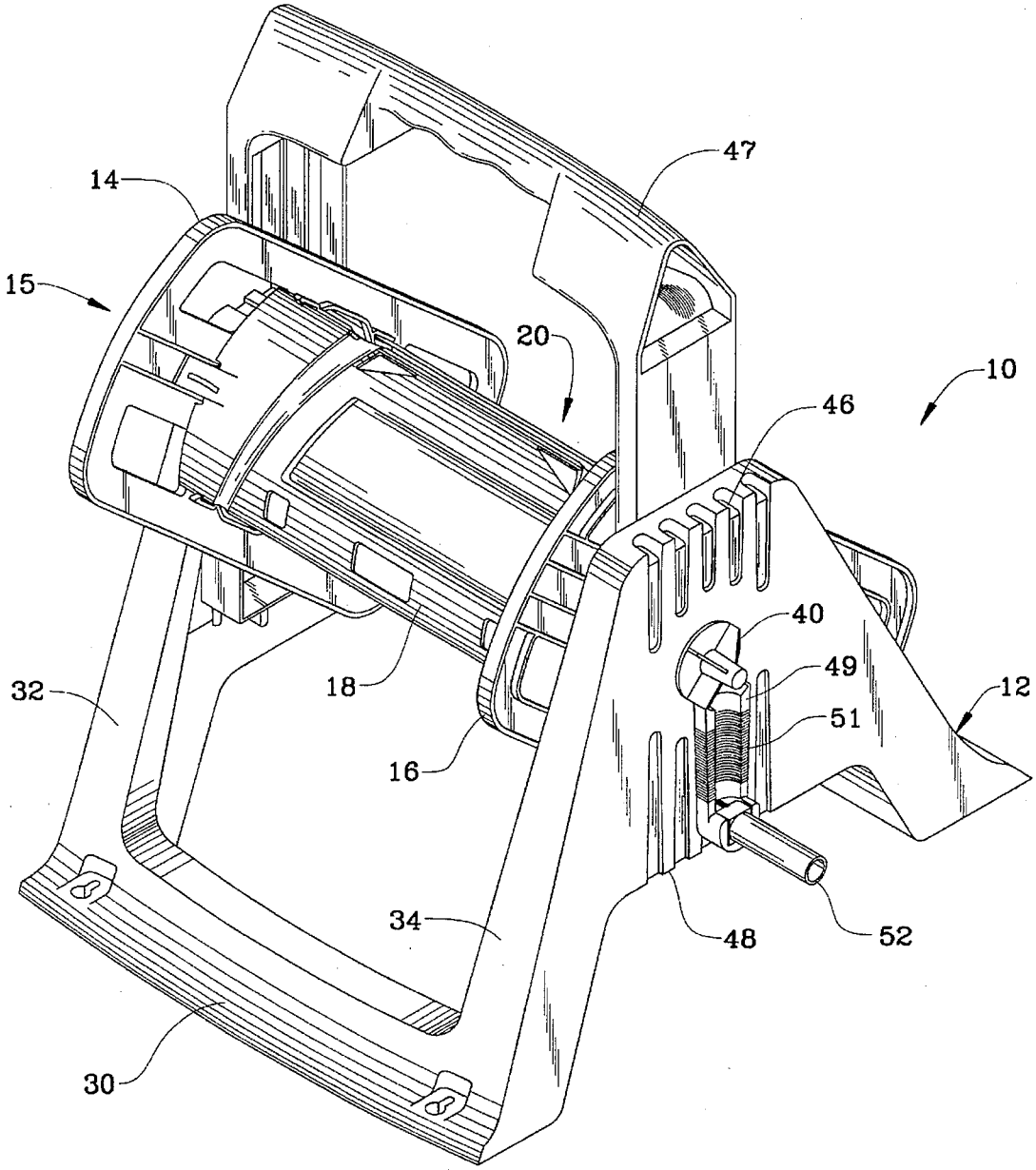
FIG. 1 is a pictorial view of the stackable, wall mountable hose reel.
Figure 2:
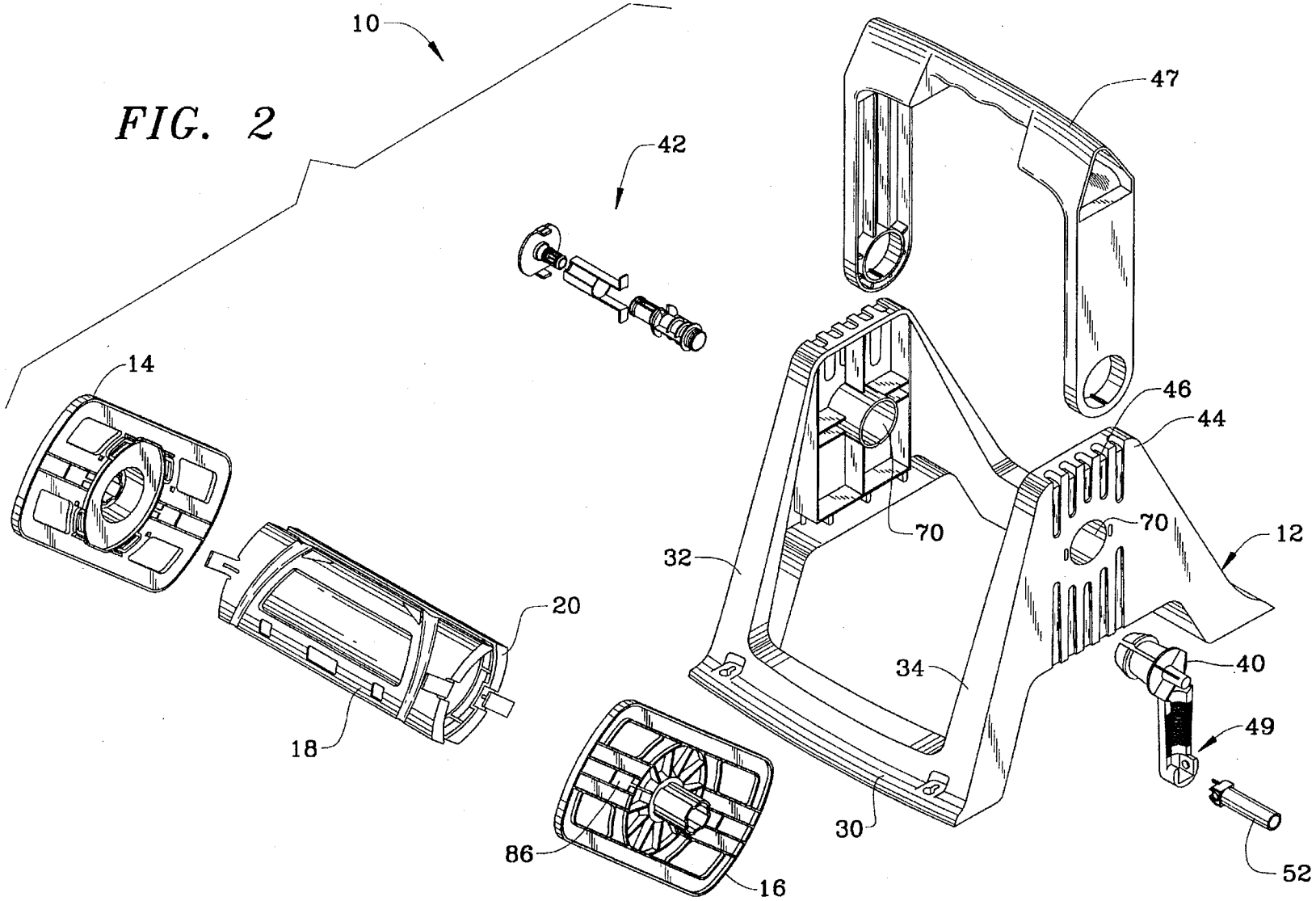
FIG. 2 is an exploded view of the frame and hose reel.

Now referring to FIGS. 1 and 2, set forth is a pictorial of the instant invention 10 consisting of a frame 12 having an oblong shaped first reel flange 14 spaced apart from a second hose reel flange 16 by opposing reel halves 18 and 20. The frame 12 consists of a one-piece frame molded from a plastic, such as polyethylene, defined by a front crossbar 30 molded to the front legs of an inverted V-shaped frame with sides 32 and 34. The frame Sides 32 and 34 are a mirror image of one another including hub shape and design allowing for the interchange of the hub's coupling devices, namely a crank 40, a hose connector 42 which will be further described later in this description. An upper portion of the frame 44 includes detent 46 which allows the nesting of similarly shaped frames on top of each other as a lower portion of the frame includes outwardly extending tabs 48 used for engaging the detent on an adjoining frame. Handle 47 includes a generally U-shaped section and is constructed of a single piece of plastic such as polyethylene with ribbed reinforcement ridges 51 along the base of the handle. The handle 47 is further defined by a pair of lateral bars each of which have an enlarged base conforming to the upper portions of the frame. A crank arm 52 pivotally folds into the handle 49. Also included in the unit is the U-shaped handle 47 which attaches to hub 70 on either side of reel assembly (or spool) 15. Accordingly, handle 47 pivots around hub 70 to facilitate stackable storage of many hose reel units (See FIG. 14) and to swing the handle into a vertical carrying position as shown in FIG. 1.

Figure 3:
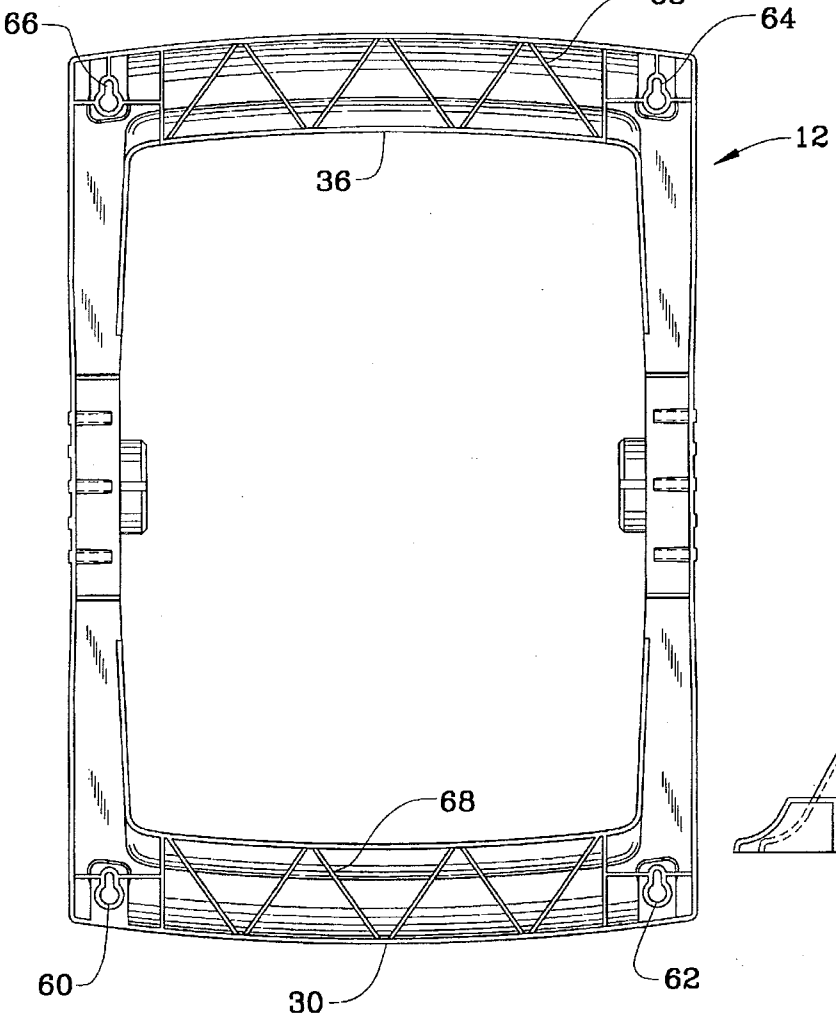
FIG. 3 is a bottom view of the frame.

Now referring to FIG. 3, shown is a bottom view of the frame having mounting apertures 60, 62, 64 and 66 located along each corner of the frame. The apertures are key hole shaped allowing placement over a mounting bolt or screw with the neck of the aperture allowing for the slidable engagement of the mounting bolt for ease of securing to a wall. The base cross pieces 30 and 36 of the frame 12 include reinforced sections 68 providing rigidity to the cross pieces. Tabs 48 are used for engagement with the detent 46 as previously described.

Figure 4:
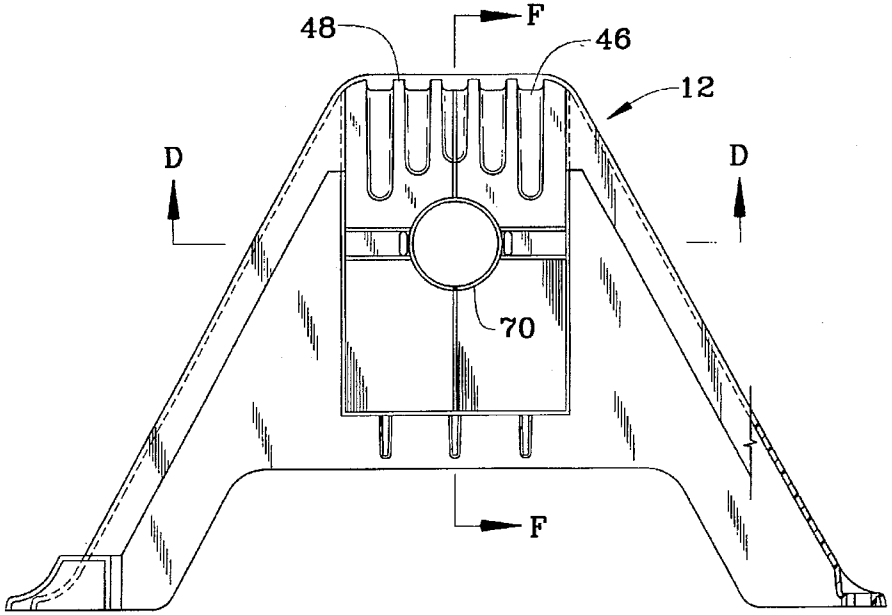
FIG. 4 is a side view of the frame.

FIG. 4 is a side view of the frame 12 depicting the detent 46 and mounting tabs 48 which are used for joining stacked adjacent frames together. Hub 70 is centrally disposed for coupling of the adjoining reel and crank or water connection assembly.

Figure 5:
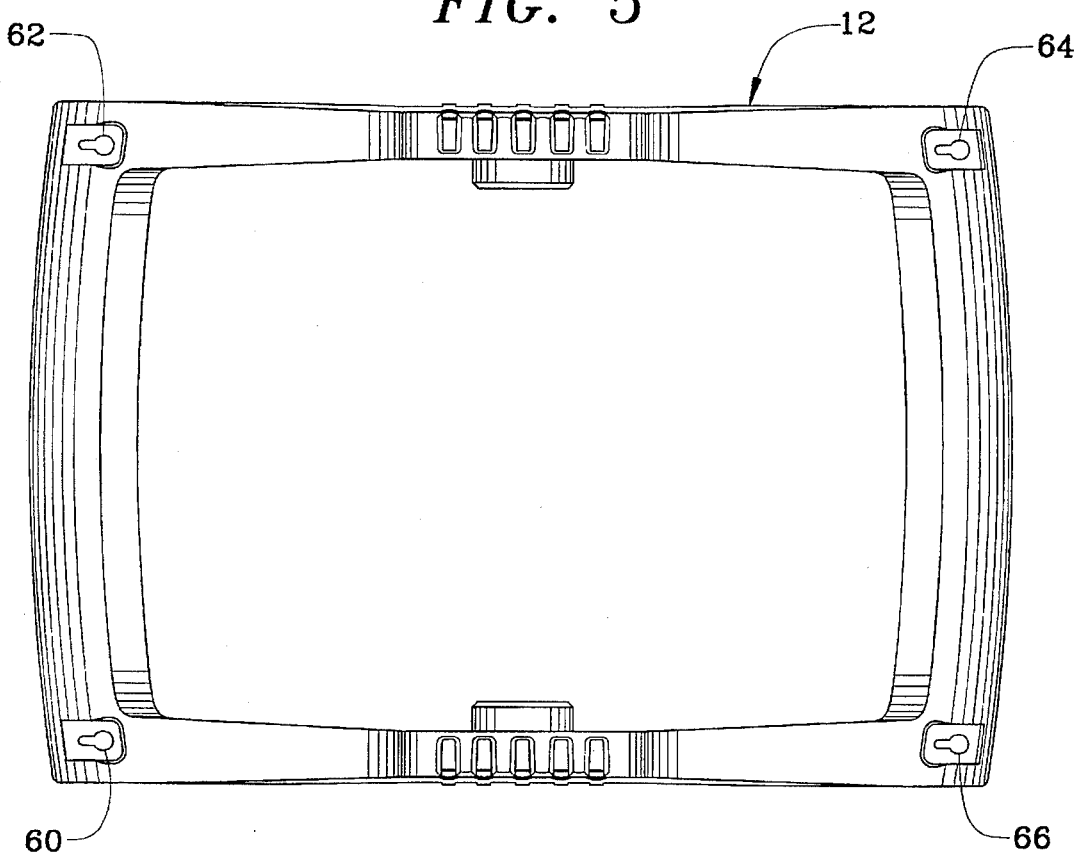
FIG. 5 is a top view of the frame.

FIG. 5 is a partial top view of the frame 12 depicting the corner located mounted holes 60, 62, 64, and 66.

Figure 6:
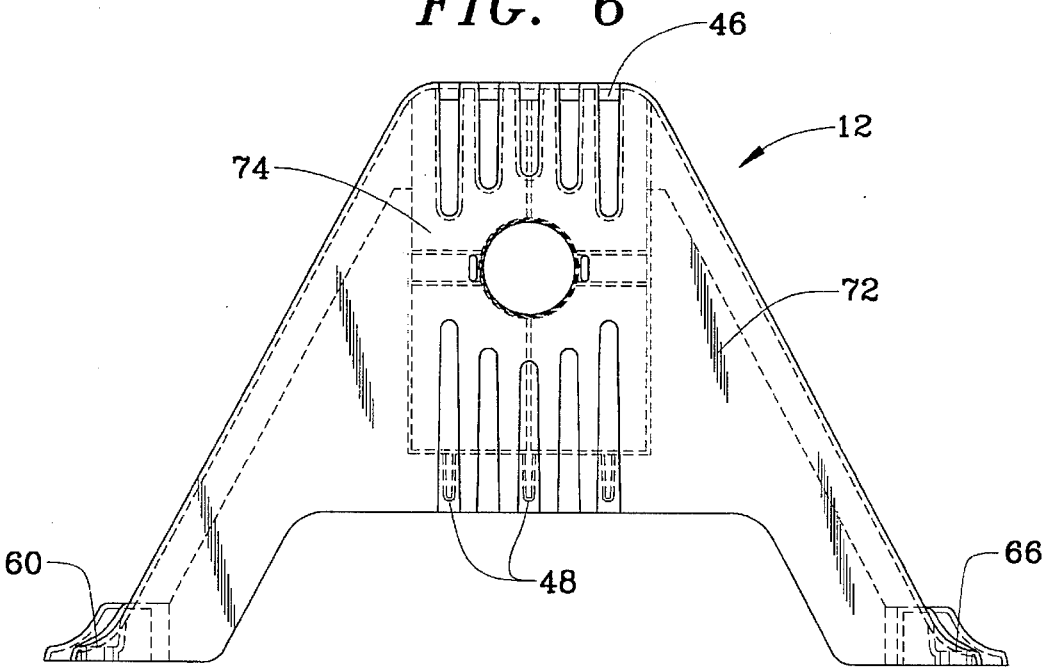
FIG. 6 is a side view of the frame with the inner side surface shown in fathom.

FIG. 6 is an inner side surface 72 view (shown in fathom) of the frame 12 having facial area 74 for placement of the reel flange and tabs 48 used for insertion into detent 46 as previously described.

Figure 7:
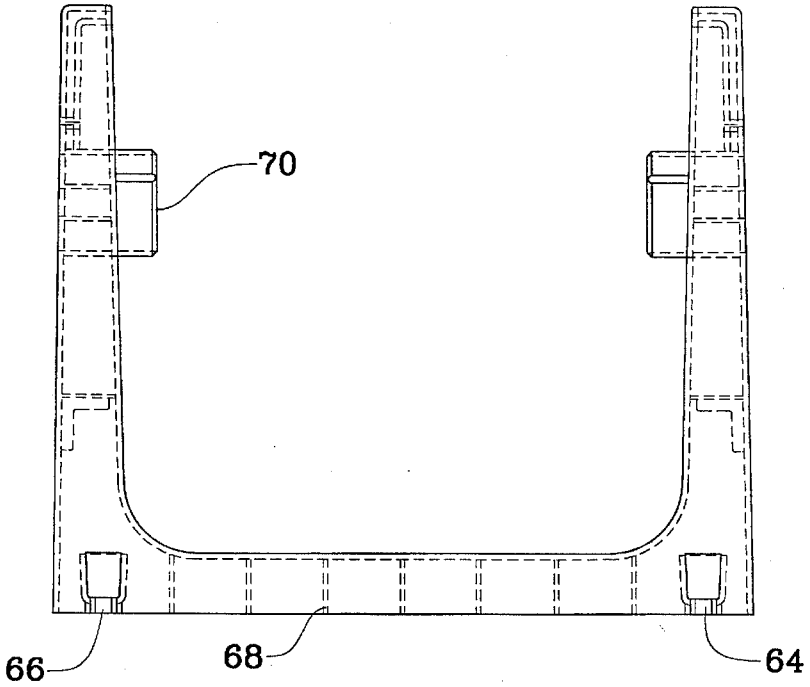
FIG. 7 is an end view of the frame, with the inner structures shown in fathom.

FIG. 7 shows an end view of the frame 12 with inner structural components shown in fathom. Hub 70 is used in securing the hose reel (not shown). Reinforcement sections 68 are shown as well as the mounting holes 64, 66.

Figure 8:
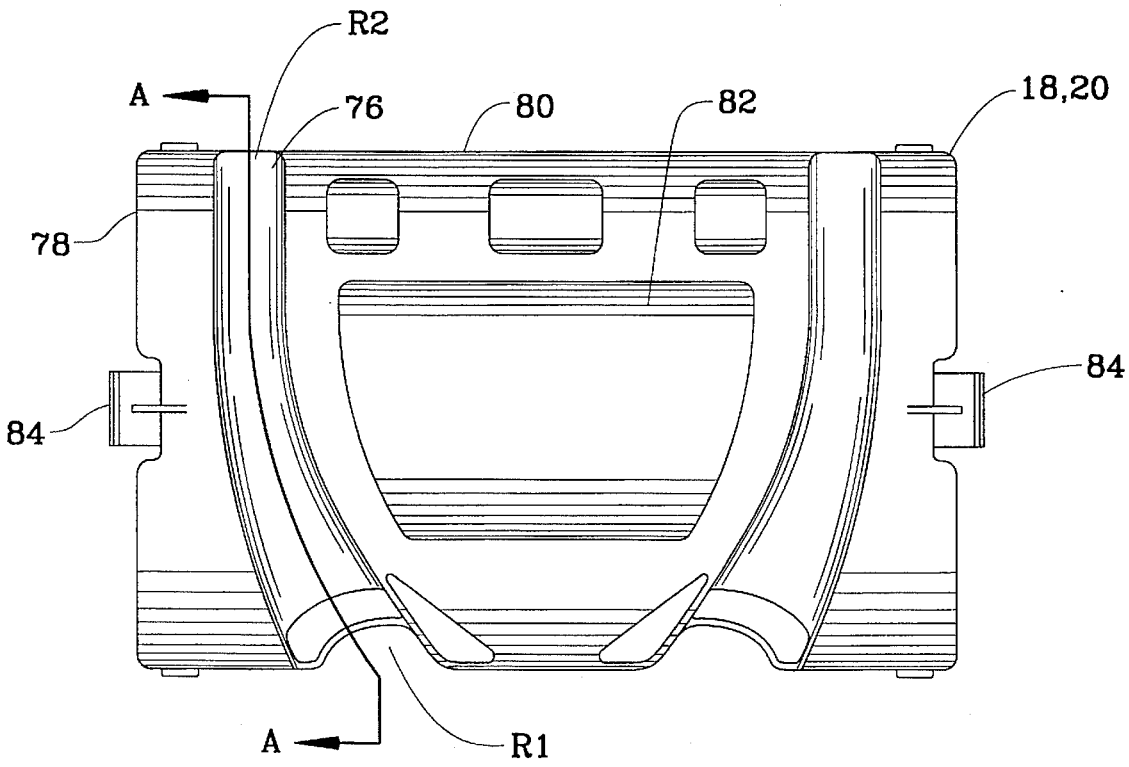
FIG. 8 is a side view of the inner hose reel assembly half.

Now referring to FIG. 8, the reel assembly is made up of two identically molded cross braces which form reel halves 18 and 20, each having a pre-formed hose cavity 76 which forms an inward slope from the first edge of approximately 0.63 inch radius R1 approximately 2.5 inches inward from side edge 78 to the second side edge 80 wherein the cavity 76 is a continuous format across the surface of the reel and tapers to approximately a 0.3 inch radius R2 inboard from the side edge 80 approximately 1 inch. Opening 82 is of sufficient size to allow the hand of an operator to thread a female hose end connector of a hose onto the male outlet of the hub found within the reel cavity. Each reel half includes an engagement tab 84 available for securing into either flange 14 or 16 having slots 86 (See also FIG. 2) for securement thereto.

Figure 9:
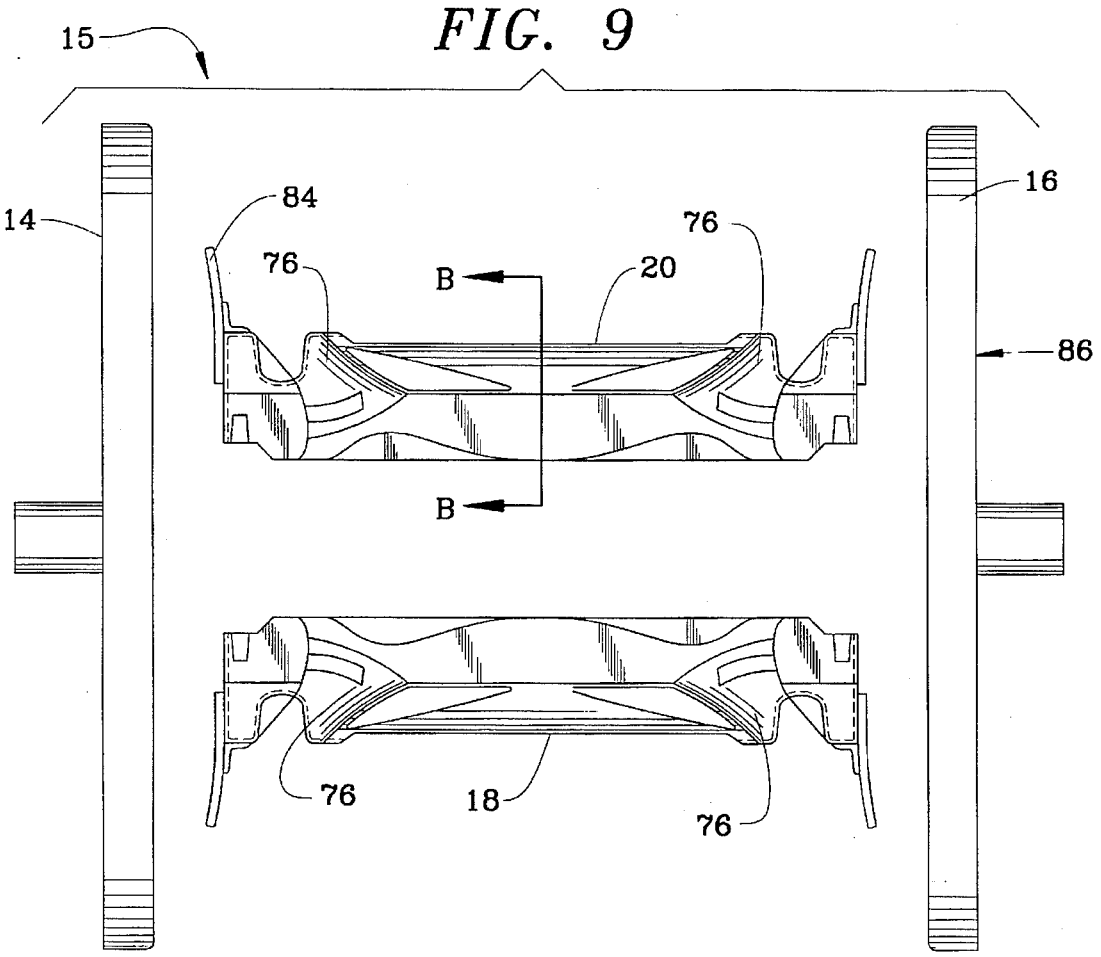
FIG. 9 is an exploded top view of the inner hose reel halves and the end flanges.

FIG. 9 shows an exploded top view of the hose reel assembly 15 with the inner hose reel halves 18 and 20 and the end flanges 14 and 16. The cavity 76, engagement tabs 84, and slots 86 as described for FIG. 8 are also shown.

Figure 10:
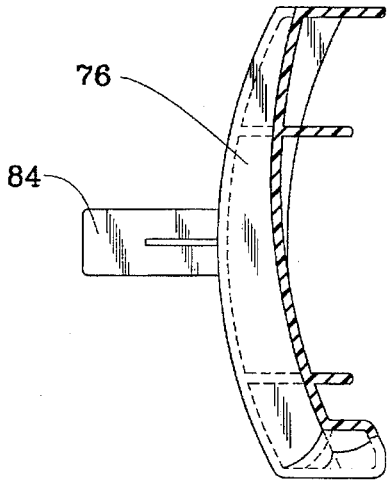
FIG. 10 is a cross-sectional view of the inner hose reel assembly half of FIG. 8 along cut A—A.
Figure 11:
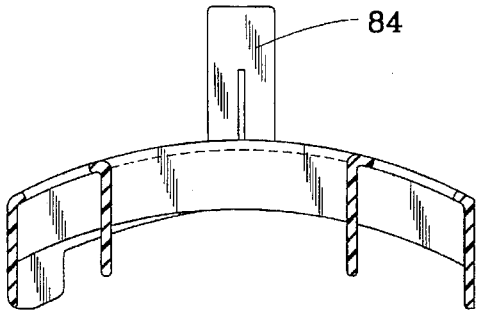
FIG. 11 is a cross-sectional view of the inner assembly piece of FIG. 9 along cut B—B.

FIG. 10 shows a cross-sectional view of the reel halves 18, 20 of FIG. 8 along cut A—A. This further demonstrates the formation of cavity 76. FIG. 11 shows a cross-sectional view of the reel half 20 of FIG. 9 along cut B—B, which similarly shows structural formations.

Figure 12:
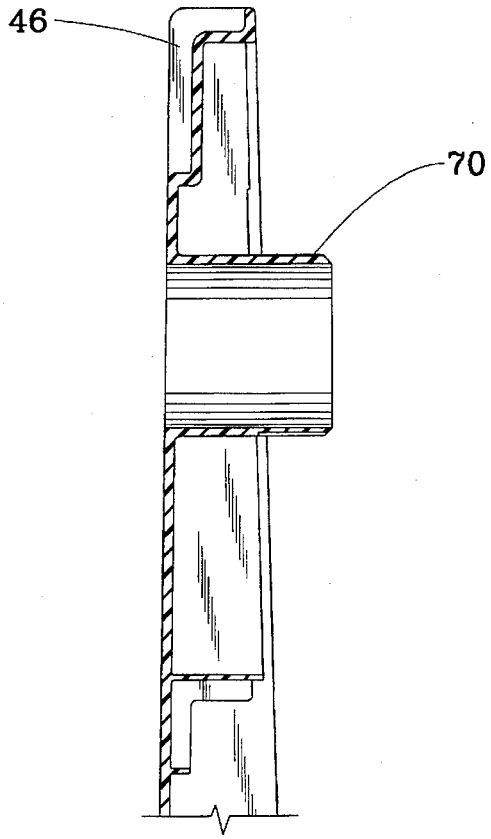
FIG. 12 is a cross-sectional view of the frame of FIG. 4 along cut F—F.
Figure 13:
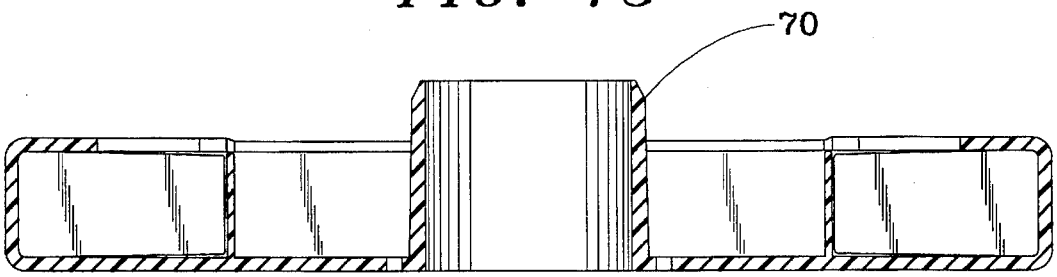
FIG. 13 is a cross-sectional view of the frame of FIG. 4 along out D—D.

FIG. 12 shows a cross-sectional view of the frame 12 of FIG. 4 along cut F—F. This view further demonstrates the structural formation of hub 70 and detents 46. FIG. 13 shows a cross-sectional view of the frame 12 of FIG. 4 along cut D—D. Again, this view also demonstrates the structural formation of hub 70 within frame 12.

Figure 14:
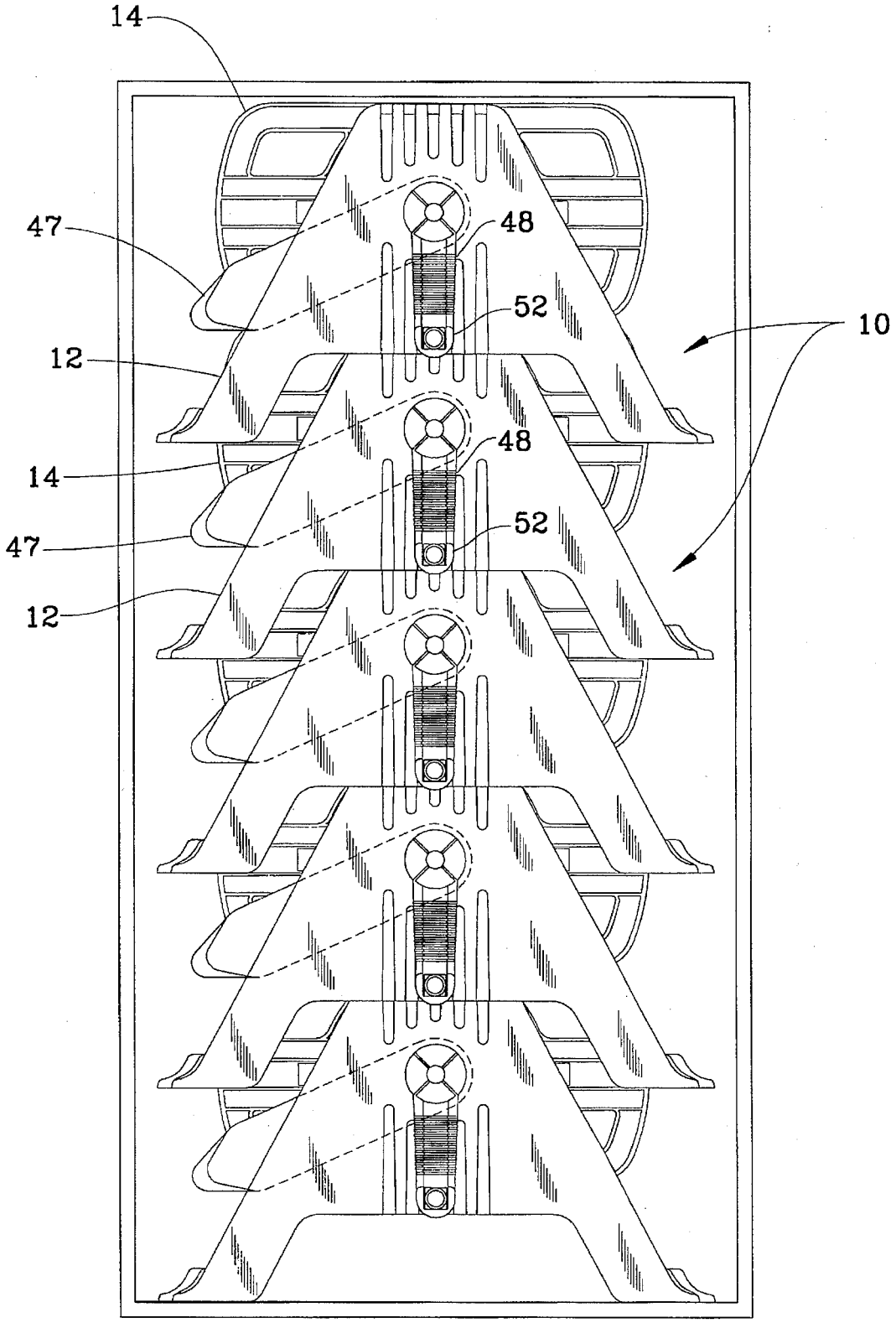
FIG. 14 is a pictorial view of the wall mounted hose reels placed in a stored and stacked position.

FIG. 14 is a pictorial view of a plurality of wall mount hose reels 10 illustrating utility of the reel flanges 14 when the frames 12 are placed in a nesting position. As shown by way of illustration, the reel flanges 14 nest while in a stacked position. Hidden lines illustrate the angular direction of the flanges 14 and the handles 48 are placed in a storage position with crank arm 52 rotated and locked into position along a pivot point so as non to extend outward from each side frame. The carrying handle 47 is also shown as pivoted to an optimal position for stacking of multiple units 10. As further detailed in prior art reference U.S. Pat. No. 5,425,391 by this same inventor, the crank arm 52 is foldable into a storage position and includes an aperture in which pivot ears extend and provide a force fit attachment allowing pivotal rotation without further securement. During use, extension of the handle's crank rest against a resting surface on the arm allows the handle to reside in a perpendicular position to the handle providing optimum leverage during rotation of the reel. A lock tab on the end of the crank hooks the crank arm extension into perpendicular position.

It is to be understood that while we have illustrated and described certain forms of our invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A stackable hose storage apparatus for windably holding an elongated flexible garden hose comprising:

a single piece support frame defined by two frame sides each having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs;

a spool disposed between said frame sides, said spool having a plurality of cross-braces defining a reel surface for receipt of a flexible hose, said reel surface coupled between a first and second oblong shaped reel flange defined by a length and a width with said length greater than said width, each said reel flange having a centrally disposed hub operatively associated with each said frame side hub bearing surface;

a hose connector releasably insertable through one of said hubs providing an inlet connection mounted in a fixed position on one frame side, said frame side and through said reel flange fluidly communicated to an outlet adapter on a second side of said flange;

a U-shaped carrying handle attached to said centrally disposed hubs between said reel flanges and said frame sides so that the handle can freely pivot around the hub axis for positioning as a carrying handle or for stackable storage;

a means for attachably mounting said hose storage apparatus to a vertically disposed surface.

2. The hose storage apparatus according to claim 1 wherein each said cross-braces are further defined as two semi-circular brackets forming identical reel surface halves.

3. The hose storage apparatus according to claim 2 wherein each said reel surface includes at least one hose relief cavity comprising an inward slope depending from a first edge of said reel surface having a first depth set a first distance from an end of said reel surface to a second edge of said reel surface at a depth less than said first depth and set a second distance from said first end of said reel surface.

4. The hose storage apparatus according to claim 2 wherein each said reel surface includes at least one aperture of sufficient size whereby said aperture allows an operator to couple a free end of a flexible hose to said hose connector.

5. The hose storage apparatus according to claim 1 wherein said hose connector includes: a hose male connector being adaptable for connection to flexible hose available for winding about the spool, a hose female adapter being adaptable for connection to an inlet hose, and a coupling sleeve, said hose male connector having at least one O-ring contacting the hose female adapter to form a seal therebetween.

6. The hose storage apparatus according to claim 5 wherein said coupling sleeve is further defined as a plurality of inwardly biased tabs available for locking said hose male connector to said hose female connector, said tabs operatively associated with said hose female connector.

7. The hose storage apparatus according to claim 6 wherein said tabs are removed from a biased position with said hose female connector by pulling said coupling sleeve away from said female hose connector.

8. The hose storage apparatus according to claim 1 wherein said crank includes a handle constructed of moldable plastic material pivotally attached to a shank of said crank being positionable from a perpendicular position for rotation to a raised position to facilitate storage, said handle frictionally engaging said shank for securement in a raised or lowered position.

9. The hose storage apparatus according to claim 8 wherein said crank may be placed in either hub providing operation in a left hand or right hand position.

10. The hose storage apparatus according to claim 1 wherein said frame is constructed from a single piece of plastic further defining each said frame side by inverted V-shaped structures having a flattened top portion and split legs depending therefrom, said frame positionable on another frame allowing a nesting arrangement.

11. The hose storage apparatus according to claim 1 wherein said handle includes a cross brace providing a slot for maintaining a free end of a flexible hose in an upright position.

12. The hose storage apparatus according to claim 1 wherein said first and second oblong shaped reel flange includes a means for coupling two of said cross-braces in a fixed diametrically opposed position.

13. The hose storage apparatus according to claim 12 wherein each said oblong shaped reel flange is further defined as having a length of approximately 15 inches and a width of approximately 7.5 inches.

14. The hose storage apparatus according to claim 1 wherein each said oblong shaped reel flange hub includes four equal spaced indentations operatively associated with spaced apart engagement tabs of said crank.

15. The hose storage apparatus according to claim 1 wherein each said oblong shaped reel flange hub includes four equal spaced indentations operatively associated with spaced apart engagement tabs of said hose coupler.

16. The hose storage apparatus according to claim 1 wherein each said oblong shaped reel flange hub includes a flat front surface proximal to a centrally disposed aperture and a ribbed back surface providing support for an elongated extension of said aperture.

17. A stackable hose storage apparatus for windably holding an elongated flexible garden hose comprising:

a single piece support frame having two inverted V-shaped frame sides, each said frame side having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs;

a spool disposed between said frame sides, said spool having a plurality of cross-braces defining a reel surface for receipt of a flexible hose, said reel surface coupled between a first and second oblong shaped reel flange having a length and a width with said length greater than said width, each said reel flange having a centrally disposed hub operatively associated with each said frame side;

a hose connector comprising a hose male connector being adaptable for connection to flexible hose available for winding about said spool, a hose female connector being adaptable for connection to an inlet hose, and a coupling sleeve, said hose male connector having at least one O-ring contacting said hose female connector to form a seal therebetween, said hose connector releasably insertable through one of said hubs providing an inlet connection mounted in a fixed position on one side of a said reel flange fluidly communicated to an outlet adapter on a second side of said flange;

a crank releasably insertable through one of said hubs providing a direct coupling to said spool allowing rotation thereof, said crank including a crank handle pivotally attached to said crank being positionable from a perpendicular position for hand operation to a raised position to facilitate storage;

a U-shaped carrying handle attached to said centrally disposed hubs between said reel flanges and said frame sides so that the handle can freely pivot around the hub axis for positioning as a carrying handle or for stackable storage;

a plurality of attachment holes in the bottom of said frame legs for attaching the hose cart to a vertically disposed surface; and wherein said carrying handle and said reel flange rotates to an optimal position allowing a fully assembled hose storage apparatus to be stacked in a nesting arrangement over a similarly assembled hose storage apparatus.

18. The hose storage apparatus according to claim 17 wherein said coupling sleeve is further defined as a plurality of inwardly biased tabs available for locking said hose male connector to said hose female connector, said tabs operatively associated with said hose female connector.

19. The hose storage apparatus according to claim 17 wherein said tabs are removed from a biased position with said hose female connector by pulling said coupling sleeve away from said female hose connector.

20. The hose storage apparatus according to claim 17 wherein said handle of said crank maintained in a raised position by frictional engagement.

21. The hose storage apparatus according to claim 17 wherein said cross brace defines a plurality of cavities of sufficient angular shape so as to allow a flexible hose to couple to said female coupling at an angle providing a gradual slope for relief of hose stress upon coupling of the flexible hose to a said male hose connector.

22. The hose storage apparatus according to claim 21 wherein said cavities allow directional placement of a flexible hose whereby the flexible hose can be wound about said spool of the apparatus in a clockwise or counter clockwise direction.

* * * * *